US008135138B2

(12) United States Patent
Wessel et al.

(10) Patent No.: US 8,135,138 B2
(45) Date of Patent: Mar. 13, 2012

(54) HEARING AID FITTING PROCEDURE AND PROCESSING BASED ON SUBJECTIVE SPACE REPRESENTATION

(75) Inventors: David Wessel, Berkeley, CA (US); Eric Battenberg, Berkeley, CA (US); Andrew Schmeder, Oakland, CA (US); Kelly Fitz, El Cerrito, CA (US); Brent Edwards, San Francisco, CA (US)

(73) Assignee: University of California, Berkeley, Berkeley, CA (US)

( * ) Notice: Subject to any disclaimer, the term of this patent is extended or adjusted under 35 U.S.C. 154(b) by 865 days.

(21) Appl. No.: 12/190,582

(22) Filed: Aug. 12, 2008

(65) Prior Publication Data

US 2009/0060214 A1 Mar. 5, 2009

Related U.S. Application Data

(60) Provisional application No. 60/968,700, filed on Aug. 29, 2007.

(51) Int. Cl.
*H04R 29/00* (2006.01)

(52) U.S. Cl. ..... 381/60; 381/312

(58) Field of Classification Search ..... 381/60, 381/312, 314

See application file for complete search history.

(56) References Cited

U.S. PATENT DOCUMENTS

| | | | |
|---|---|---|---|
| 5,880,392 | A | 3/1999 | Wessel et al. |
| 6,175,635 | B1 | 1/2001 | Meyer et al. |
| 7,054,449 | B2 | 5/2006 | Ludi |
| 7,349,549 | B2 | 3/2008 | Bachler et al. |
| 2004/0071304 | A1 | 4/2004 | Yanz et al. |
| 2007/0076909 | A1 | 4/2007 | Roeck et al. |

FOREIGN PATENT DOCUMENTS

| | | | |
|---|---|---|---|
| DE | 1020070460020 | A1 | 4/2009 |
| EP | 0917398 | A2 | 5/1999 |
| EP | 1194005 | A2 | 4/2002 |

OTHER PUBLICATIONS

"Cycling, 1974 Max/MSP", 1 pg.

Borg, Ingwer, et al., "Part I—Fundamentals of MDS", *Modern Multidimensional Scaling: Theory and Applications Second Edition. Springer*, New York, NY, (2005), 3-133.

Borg, Ingwer, et al., "Part II—MDS Models and Solving MDS Problems", *Modern Multidimensional Scaling: Theory and Applications Second Edition. Springer*, New York, NY, (2005), 135-289.

Borg, Ingwer, et al., "Part III—Unfolding", *Modern Multidimensional Scaling: Theory and Applications Second Edition. Springer*, New York, NY, (2005), 291-355.

(Continued)

*Primary Examiner* — Victor A Mandala
*Assistant Examiner* — Whitney T Moore
(74) *Attorney, Agent, or Firm* — Schwegman, Lundberg, & Woessner, P.A.

(57) ABSTRACT

A system for hearing assistance devices to assist hearing aid fitting applied to individual differences in hearing impairment. The system is also usable for assisting fitting and use of hearing assistance devices for listeners of music. The method uses a subjective space approach to reduce the dimensionality of the fitting problem and a non-linear regression technology to interpolate among hearing aid parameter settings. This listener-driven method provides not only a technique for preferred aid fitting, but also information on individual differences and the effects of gain compensation on different musical styles.

20 Claims, 8 Drawing Sheets

OTHER PUBLICATIONS

Borg, Ingwer, et al., "Part IV—MDS Geometry as a Substantive Model", *Modern Multidimensional Scaling: Theory and Applications Second Edition. Springer*, New York, NY, (2005), 357-426.
Borg, Ingwer, et al., "Part V—MDS and Related Methods", *Modern Multidimensional Scaling: Theory and Applications Second Edition. Springer*, New York, NY, (2005), 427-540.
Borg, Ingwer, et al., "Part VI—Appendices", *Modern Multidimensional Scaling: Theory and Applications Second Edition. Springer*, New York, NY, (2005), 541-614.
Chasin, M, et al., "Hearing Aids and Music", *Trends in Amplification*, 8 (2), (2004), 35-47.
Crandell, C C, "Individual Differences in Speech Recognition Ability: Implications for Hearing Aid Selection", *Ear and Hearing*, 12 (6), Supplement 100S-108S, (1991).
Edwards, B, "Hearing aids and hearing impairment", *In S. Greenberg, W. Ainsworth, An. N. Popper, R. R. Fay, eds., Speech Processing in the Auditory System. Springer Verlag*, New York, NY, (2004), 339-421.
Fastl, H, "Psycho-acoustics and sound quality", *In J. Blauert, ed., Communication Acoustics* (*Signals and Communication Technology*). *Springer*, Berlin, Germany, (2005), 139-162.
Franks, J R, "Judgments of Hearing Aid Processed Music", *Ear and Hearing* 3, (1), (1982), 18-23.
Goldstone, R L, "An efficient method for obtaining similarity data", *Behavior Research Methods, Instruments, & Computers*, 26 (4), (1994), 381-386.
Momeni, D, et al., "Characterizing and controlling musical material intuitively with geometric models", *In Proceedings of the 2003 Conference on New Interfaces for Musical Expression.* Montreal, Canada, (2003), 54-62.
Punch, J L, "Quality judgments of hearing aid-processed speech and music by normal and otopathologic listeners", *Journal of the American Audiology Society* 3 (4), (1978), 179-188.
Shepard, R N, "Multidimensional Scaling, Tree-Fitting, and Clustering.", *Science*, 210(4468), (1980), 390-398.
Shepard, R N, "Psychological Representation of Speech Sounds", *In E. David, P. B. Denes, eds., Human Communication a Unified View. McGraw-Hill*, New York, NY, (1972), 67-113.
Tufts, J B, et al., "Perception of dissonance by people with normal hearing and sensorineural hearing loss", *Acoustical Society of America Journal*, 118, (2005), 955-967.
Wessel, D., et al., "Optimizing Hearing Aids for Music Listening", *19th International Congress on Acoustics*, Madrid, Sep. 2-7, 2007, 6 pages.
"European Application Serial No. 08163218.4, Extended European Search Report mailed Mar. 3, 2011", 9 pgs.
"European Application Serial No. 08163218.4, Invitation to Proceed dated Apr. 11, 2011", 2 pgs.
"European Application Serial No. 08163218.4, Response filed Oct. 3, 2011 to Office Action mailed Mar. 3, 2011", 10 pgs.
Carr, J C, et al., "Reconstruction and Representation of 3D Objects with Radial Basis Functions", Proceedings of the 28th Annual Conference on Computer Graphics and Interactive Techniques. (SIGGRAPH '01), 2001. Conference Proceedings, (2001), 67-76.

HEARING AID FITTING PROCEDURE AND PROCESSING BASED ON SUBJECTIVE SPACE REPRESENTATION

CLAIM OF BENEFIT AND INCORPORATIONS BY REFERENCE

This application claims the benefit of U.S. Provisional Patent Application Ser. No. 60/968,700 entitled HEARING AID FITTING PROCEDURE AND PROCESSING BASED ON SUBJECTIVE SPACE REPRESENTATION, filed Aug. 29, 2007, which is hereby incorporated by reference in its entirety. All cited references in U.S. Provisional Patent Application Ser. No. 60/968,700 and in this nonprovisional patent application are incorporated herein by reference in their entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND

Advances in modern digital hearing aid technology focus almost entirely on improving the intelligibility of speech in noisy environments. The effects of hearing aid processing on musical signals and on the perception of music receive very little attention, despite reports that hardness of hearing is the primary impediment to enjoyment of music in older listeners, and that hearing aid processing is frequently so damaging to musical signals that hearing aid wearers often prefer to remove their hearing aids when listening to music.

Though listeners and musicians who suffer hearing impairment are no less interested in music than normal hearing listeners, there is evidence that the perception of fundamental aspects of (Western) musical signals, such as the relative consonance and dissonance of different musical intervals, is significantly altered by hearing impairment (J. B. Tufts, M. R. Molis, M. R. Leek, Perception of dissonance by people with normal hearing and sensorineural hearing loss, Acoustical Society of America Journal 118 (2005) 955-967). Measures such as the Articulation Index and the Speech Intelligibility Index (American National Standards Institute, New York, N.Y., ANSI S3.5-1997, *Methods for the calculation of the speech intelligibility index* (1997)) can be used to predict intelligibility from the audibility of speech cues across all frequencies, and a variety of objective tests of speech comprehension are used to measure hearing aid efficacy, but there is no standard metric for measuring a patient's perception of music. Moreover, hearing impaired listeners are less consistent in their judgments about what they hear than are normal hearing listeners (J. L. Punch, Quality judgments of hearing aid-processed speech and music by normal and otopathologic listeners, Journal of the American Audiology Society 3 (1978), no. 4 179-188), and individual differences in performance among listeners having similar audiometric thresholds make it difficult to predict the perceptual effects of hearing aid processing (C. C. Crandell, Individual Differences in Speech Recognition Ability Implications for Hearing Aid Selection, Ear and Hearing 12 (1991), no. 6 Supplement 100S-108S). These factors, combined with the differences in the acoustical environments in which different styles of music are most often presented, underline the importance of individual preferences in any study of the effects of hearing aid processing on the perception of music. There have been studies on the effect of reduced bandwidth on the perceived quality of music (J. R. Franks, Judgments of Hearing Aid Processed Music, Ear and Hearing 3 (1982), no. 1 18-23), but no systematic evaluation of the effects of dynamic range compression, the most ubiquitous form of gain compensation in digital hearing aids.

There is a need in the art for an improved system for programming hearing assistance devices which incorporates the listener's preferences and provides the listener a convenient interface to subjectively tailor sound processing of a hearing assistance device. There is also a need in the art for a system for hearing assistance devices that allows for better appraisal of the processing of music. Such a system will provide benefit for the fitting of other sound processing technology in hearing assistant devices for which the fitting to hearing loss diagnostics is unknown but for which fitting can be made based on assessment of subjective preference.

SUMMARY

This application provides a subjective, listener-driven system for programming parameters in a hearing assistance device, such as a hearing aid. In one embodiment, the listener controls a simplified system interface to organize according to perceived sound quality a number of presets based on parameter settings spanning parameter ranges of interest. By such organization, the system can generate a mapping of spatial coordinates of an N-dimensional space to the plurality of parameters using interpolation of the presets organized by the user. In various embodiments, a graphical representation of the N-dimensional space is used.

In one embodiment, a two-dimensional plane is provided to the listener in a graphical user interface to "click and drag" a preset in order to organize the presets by perceived sound quality; for example, presets that are perceived to be similar in quality could be organized to be spatially close together while those that are perceived to be dissimilar are organized to be spatially far apart. The resulting organization of the presets is used by an interpolation mechanism to associate the two-dimensional space with a subspace of parameters associated with the presets. The listener can then move a pointer, such as PC mouse, around the space and alter the parameters in a continuous manner. If the space and associated parameters are connected to a hearing assistance device that has parameters corresponding to the ones defined by the subspace, then the parameters in the hearing device are also adjusted as the listener moves a pointer around the space; if the hearing device is active, then the listener hears the effect of the parameter change caused by the moving pointer. In this way, the listener can move the pointer around the space in an orderly and intuitive way until they determine one or more points or regions in the space where they prefer the sound processing that they hear.

In one embodiment, a radial basis function network is used as a regression method to interpolate a subspace of parameters. The listener navigates this subspace in real time using an N-dimensional graphical interface and is able to quickly converge on his or her personally preferred sound which translates to a personally preferred set of parameters.

One of the advantages of this listener-driven approach is to provide the listener a relatively simple control for several parameters.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their legal equivalents.

DETAILED DESCRIPTION

Figure 1A:
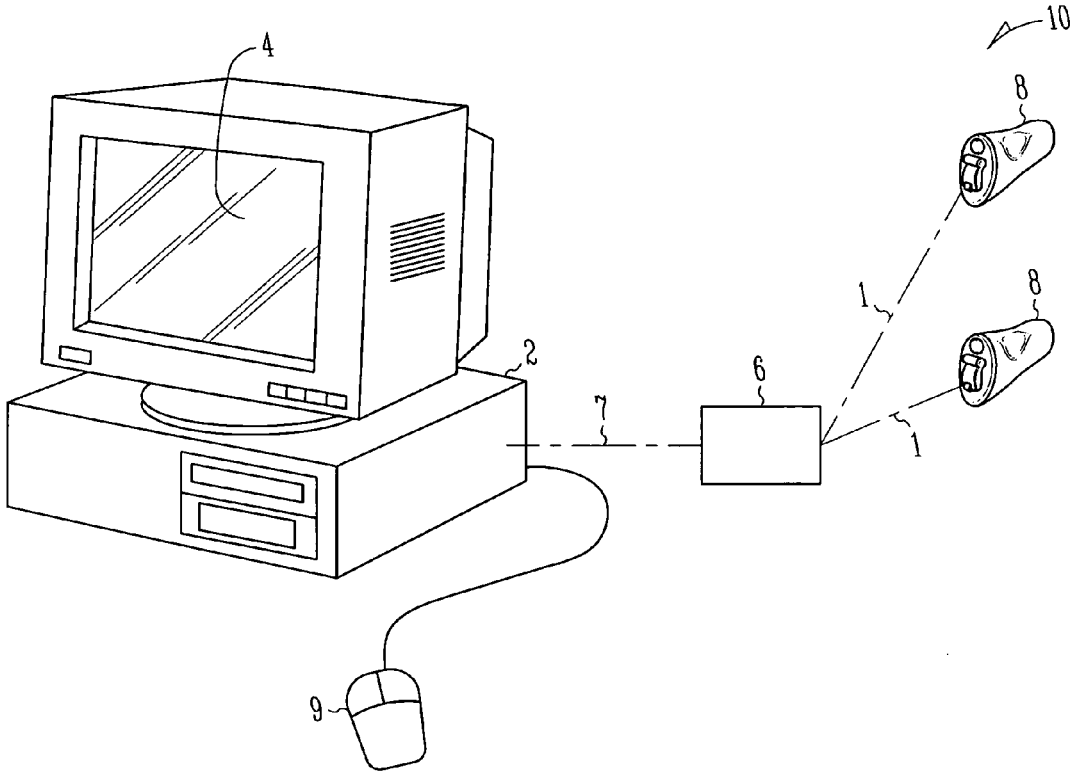
FIG. 1A demonstrates one example of a programming system 10 for hearing aids, according to one embodiment of the present subject matter.

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

This application provides a subjective, listener-driven system for programming parameters in a hearing assistance device, such as a hearing aid. In one embodiment, the listener controls a simplified system interface to organize according to perceived sound quality a number of presets based on parameter settings spanning parameter ranges of interest. By such organization, the system can generate a mapping of spatial coordinates of an N-dimensional space to the plurality of parameters using interpolation of the presets organized by the user. In various embodiments, a graphical representation of the N-dimensional space is used.

In one embodiment, a two-dimensional plane is provided to the listener in a graphical user interface to "click and drag" a preset in order to organize the presets by perceived sound quality; for example, presets that are perceived to be similar in quality could be organized to be spatially close together while those that are perceived to be dissimilar are organized to be spatially far apart. The resulting organization of the presets is used by an interpolation mechanism to associate the two-dimensional space with a subspace of parameters associated with the presets. The listener can then move a pointer, such as PC mouse, around the space and alter the parameters in a continuous manner. If the space and associated parameters are connected to a hearing assistance device that has parameters corresponding to the ones defined by the subspace, then the parameters in the hearing device are also adjusted as the listener moves a pointer around the space; if the hearing device is active, then the listener hears the effect of the parameter change caused by the moving pointer. In this way, the listener can move the pointer around the space in an orderly and intuitive way until they determine one or more points or regions in the space where they prefer the sound processing that they hear.

In one embodiment, a radial basis function network is used as a regression method to interpolate a subspace of parameters. The listener navigates this subspace in real time using an N-dimensional graphical interface and is able to quickly converge on his or her personally preferred sound which translates to a personally preferred set of parameters.

One of the advantages of this listener-driven approach is to provide the listener a relatively simple control for several parameters.

Dimensionality Reduction Via a Subjective Space Approach Based on Perceptual Dissimilarity Characterizing perceptual dissimilarity as distance in a geometric representation has provided auditory researchers with a rich set of robust methods for studying the structure of perceptional attributes (R. N. Shepard, Multidimensional Scaling, Tree-Filling, and Clustering, Science 210 (1980), no. 4468 390-398). Examples include spaces for vowels and consonants (R. N. Shepard, Psychological Representation of Speech Sounds, E. David, P. B. Denes, eds., *Human Communication a United View*, McGraw-Hill, New York, N.Y. (1972) 67-113), timbres of musical instruments, rhythmic patterns, and musical chords (A. Momeni, D. Wessel, Characterizing and controlling musical material intuitively with geometric models, *Proceedings of the* 2003 *Conference on New Interfaces for Musical Expression*, Montreal, Canada (2003) 54-62). The most common method for generating a spatial representation is the multidimensional scaling (MDS) of pairwise dissimilarity judgments (I. Borg, P. J. F. Groenen. *Modern Multidimensional Scaling. Theory and Applications*. Springer, New York, N.Y. (2005)). In this method, subjects typically rate the dissimilarity for all pairs in a set of stimuli. The stimuli are treated as points in a low dimensional space, often two-dimensional, and the MDS method finds the spatial layout that maximizes the correlation between distances in the representation and subjective dissimilarity ratings among the stimuli. As an alternative to the MDS method we (A. Momeni, D. Wessel, Characterizing and controlling musical material intuitively with geometric models, *Proceedings of the* 2003 *Conference on New Interfaces for Musical Expression*, Montreal, Canada (2003) 54-62) and Wessel (1979) "Timbre space as a musical control structure," *Computer Music Journal,* 3(2):45-52) and others (R. L. Goldstone, An efficient method for obtaining similarity data, Behavior Research Methods, Instruments, & computers 26 (1994), no, 4 381-386) have found that directly arranging the stimuli in a subjectively meaningful spatial layout provides representations comparable in quality to MDS.

The present subject matter provides a system having a user interface that allows a listener to organize a number of presets that are designed to span a parameter range of interest. The listener is able to subjectively organize the preset settings in an N-dimensional space. The resulting organization provides the system a relation of the preset parameters that is processed to generate a mapping of spatial coordinates of an N-dimensional space to the plurality of parameters using interpolation of the presets. The listener can then "navigate" through the N-dimensional mapping using the interface while listening to sound processed according to the interpolated parameters and find one or more preferred settings. This system allows a user to control a relatively large number of parameters with a single control and to find one or more preferred settings using the interface. Parameters are interpolated in real time, as the listener navigates the space, so that the listener can hear the effects of the continuous variation in the parameters.

The following description will demonstrate a process for an application using hearing aids, however, it is understood that the present teachings may be used for a variety of other applications, including, but not limited to, listening to music with headphones.

FIG. 1A demonstrates one example of a programming system 10 for hearing aids, according to one embodiment of the present subject matter. Computer 2 communicates with hearing aids 8 via programmer 6. Communications may be conducted over link 7 either using wired or wireless connections. Communications 1 between programmer 6 and hearing aids 8 may be conducted over wired, wireless or combinations of wired and wireless connections. It is further understood that hearing aids 8 are shown as completely-in-the-canal (CIC) hearing aids, but that any type of devices, including but not limited to, in-the-ear (ITE), behind-the-ear (BTE), receiver-in-the-canal (RIC), cochlear implants, headphones, and hearing assistance devices generally as may be developed in the future may be used without departing from the scope of the present subject matter. It is further understood that a single hearing aid may be programmed and thus, the present subject matter is not limited to dual hearing aid applications. Computer 2 is shown as a desktop computer, however, it is understood that computer 2 may be any variety of computer, including, but not limited to, a laptop, a tablet personal computer, or other type of computer as may be developed in the future. Computer 2 is shown as having a screen 4. The screen 4 is demonstrated as a cathode ray tube (CRT), but it is understood that any type of screen may be used without departing from the scope of the present subject matter. Computer 2 also has an input device 9, which is demonstrated as a mouse; however, it is understood that input device 9 can be any input device, including, but not limited to, a touchpad, a joystick, a trackball, or other input device.

Figure 1B:
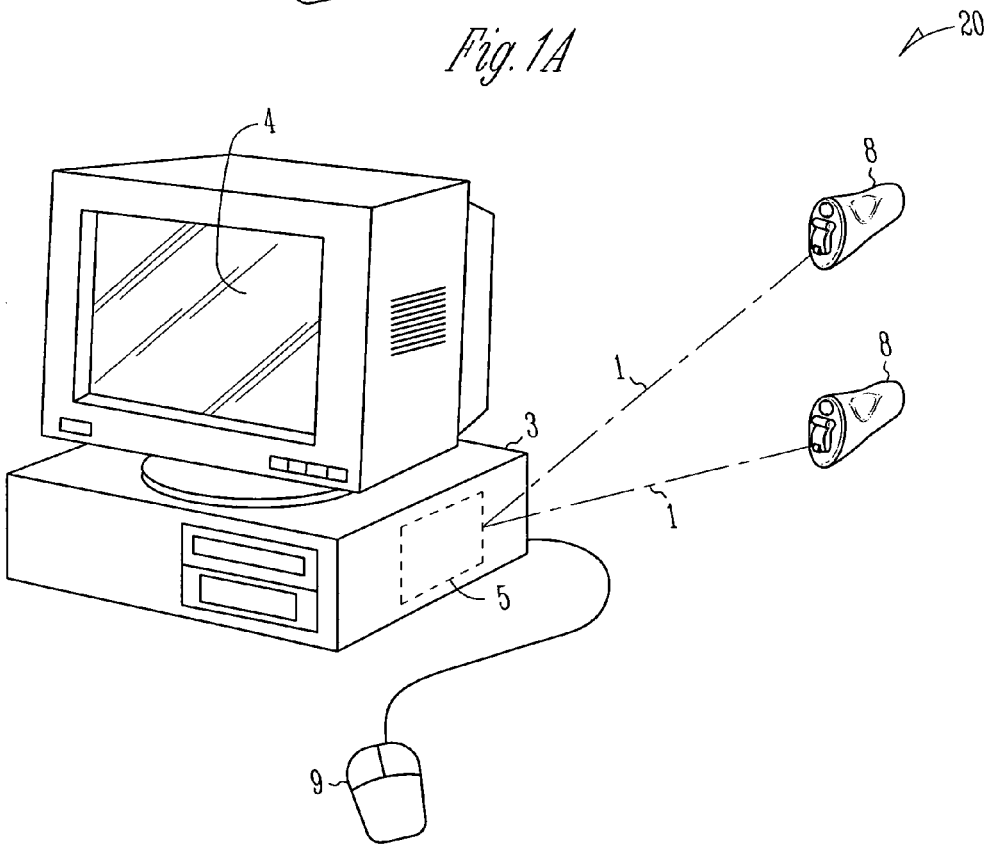
FIG. 1B demonstrates another example of a programming system 20 for hearing aids, according to one embodiment of the present subject matter.

FIG. 1B demonstrates another example of a programming system 20 for hearing aids, according to one embodiment of the present subject matter. In FIG. 1B, computer 3 has internal programming electronics 5 which are native to the computer 3. For like-numbered components, the discussion above is incorporated by reference. Communications 1 between computer 3 and hearing aids 8 may be conducted over wired, wireless or combinations of wired and wireless connections. Computer 3 is shown as a desktop computer, however, it is understood that computer 3 may be any variety of computer, including, but not limited to, a laptop, a tablet personal computer, or other type of computer as may be developed in the future.

Figure 2A:
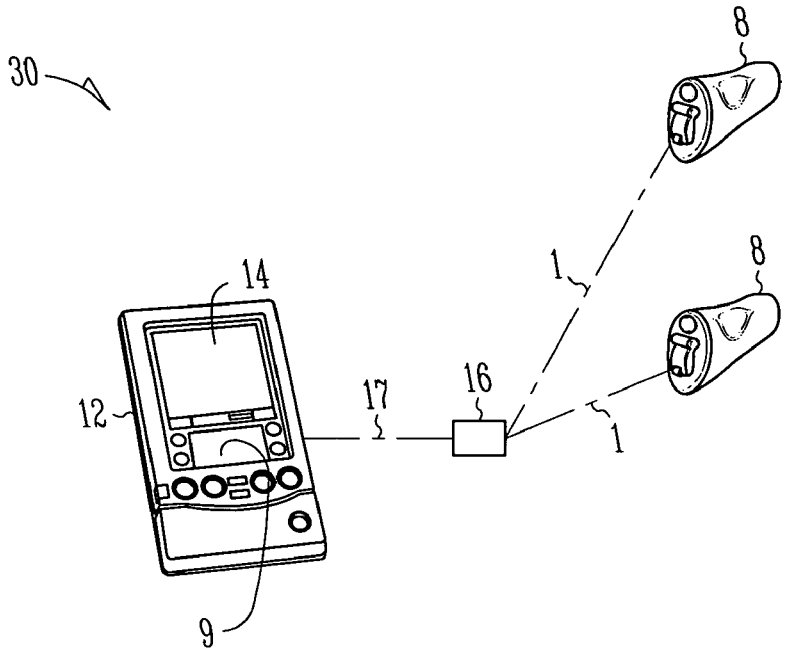
FIG. 2A demonstrates another example of a programming system 30 for hearing aids, according to one embodiment of the present subject matter.

FIG. 2A demonstrates another example of a programming system 30 for hearing aids, according to one embodiment of the present subject matter. The handheld device 12 communicates with hearing aids 8 via programmer 16. Communications may be conducted over link 17 either using wired or wireless connections. Communications 1 between programmer 16 and hearing aids 8 may be conducted over wired, wireless or combinations of wired and wireless connections. It is further understood that hearing aids 8 are shown as completely-in-the-canal (CIC) hearing aids, but that any type of devices, including but not limited to, in-the-ear (ITE), behind-the-ear (BTE), receiver-in-the-canal (RIC), cochlear implants, headphones, and hearing assistance devices generally as may be developed in the future may be used without departing from the scope of the present subject matter. It is further understood that a single hearing aid may be programmed and thus, the present subject matter is not limited to dual hearing aid applications. Handheld device 12 is demonstrated as a cell phone, however, it is understood that handheld device 12 may be any variety of handheld computer, including, but not limited to, a personal digital assistant (PDA), an IPOD, or other type of handheld computer as may be developed in the future. Handheld device 12 is shown as having a screen 14. The screen 14 is demonstrated as a liquid crystal display (LCD), but it is understood that any type of screen may be used without departing from the scope of the present subject matter. Computer 2 also has various input devices 9, including buttons and/or a touchpad; however, it is understood that any input device, including, but not limited to, a joystick, a trackball, or other input device may be used without departing from the present subject matter.

Figure 2B:
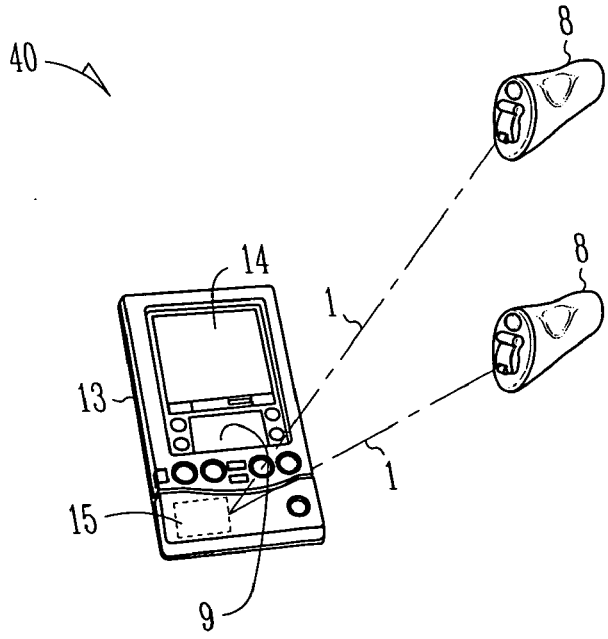
FIG. 2B demonstrates another example of a programming system 40 for hearing aids, according to one embodiment of the present subject matter.

FIG. 2B demonstrates another example of a programming system 40 for hearing aids, according to one embodiment of the present subject matter. In FIG. 2B, handheld device 13 has internal programming electronics 15 which are native to the handheld device 13. For like-numbered components, the discussions above are incorporated by reference. Communications 1 between handheld device 13 and hearing aids 8 may be conducted over wired, wireless or combinations of wired and wireless connections. Handheld device 13 is shown as a cell phone, however, it is understood that handheld device 13 may be any variety of handheld computer, including, but not limited to, a personal digital assistant (PDA), an IPOD, or other type of handheld computer as may be developed in the future.

Figure 3:
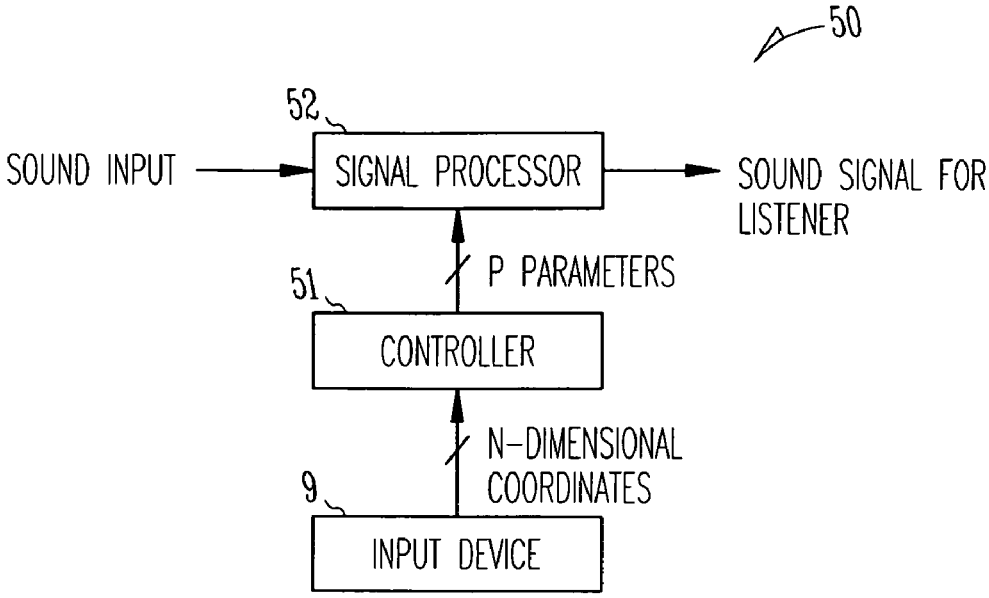
FIG. 3 demonstrates a block diagram of the present signal processing system, according to one embodiment of the present subject matter.
Figure 7A:
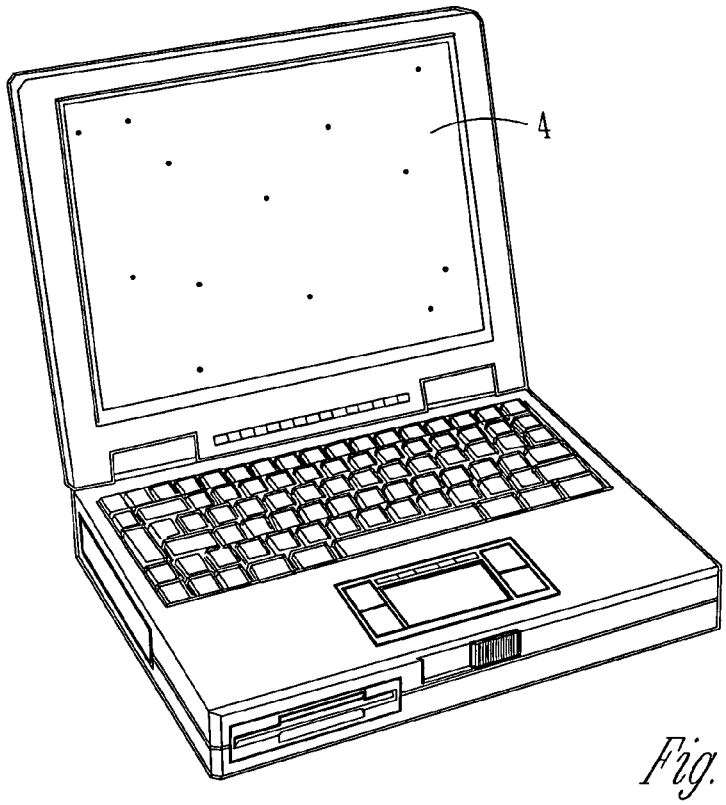
FIG. 7A shows a random arrangement of presets on a screen, according to one embodiment of the present subject matter.

FIG. 3 demonstrates a block diagram of the present signal processing system, according to one embodiment of the present subject matter. It is understood that the aspects of FIG. 3 can be realized in any of the foregoing embodiments, 10, 20, 30, and/or 40, and their equivalents. It is also understood that the aspects of FIG. 3 can be realized in hardware, software, firmware, and in combinations of two or more thereof. It is further understood that the controller 51 and signal processor 52 can be embodied in one device or in different devices, in various embodiments. The input device 9 is adapted to move a cursor on screen 4 to a coordinate in an N-dimensional space displayed on screen 4. The N coefficients of the position of the cursor are provided to the controller 51 which converts them into P parameters for signal processor 52. These P parameters are provided to a signal processing algorithm executing on signal processor 52 which processes the sound input and provides a processed sound signal to be played to the listener. The controller 51 can use a variety of methods for mapping the N coefficients to the P parameters. In various embodiments, an interpolation algorithm is employed. In various embodiments interpolation within a subspace is performed using a radial basis function network as provided herein. In various embodiments, the radial basis function network includes a radial basis hidden layer and a linear output layer as discussed herein. In one embodiment, N=2, and so the screen 4 provides an X-Y plane for the user to "navigate" to control the P parameters. In the example shown in FIGS. 7A and 7B, N=2

Figure 4:
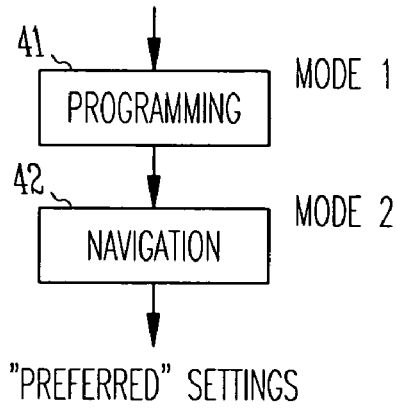
FIG. 4 demonstrates an overview of the various modes of a system, according to one embodiment of the present subject matter.

FIG. 4 demonstrates an overview of the various modes of a system, according to one embodiment of the present subject matter. In various embodiments, the system 50 is "programmed" in a first mode 41 and "navigated" in a second mode 42. The programming mode 41 includes a process by which a user can provide subjective organization of predetermined parameter settings or "presets" using the input device 9 and screen 4. The resulting organization is used to construct a mapping of coordinates of the N-dimensional space to a plurality of parameters Z. The mapping represents a weighting or interpolation of the presets organized in the programming mode. The user can then "navigate" 42 through the N-dimensional space to provide interpolated parameters Z to the signal processing algorithm and select one or more preferred listening settings as sound is played through the signal processor 52.

Figure 5:
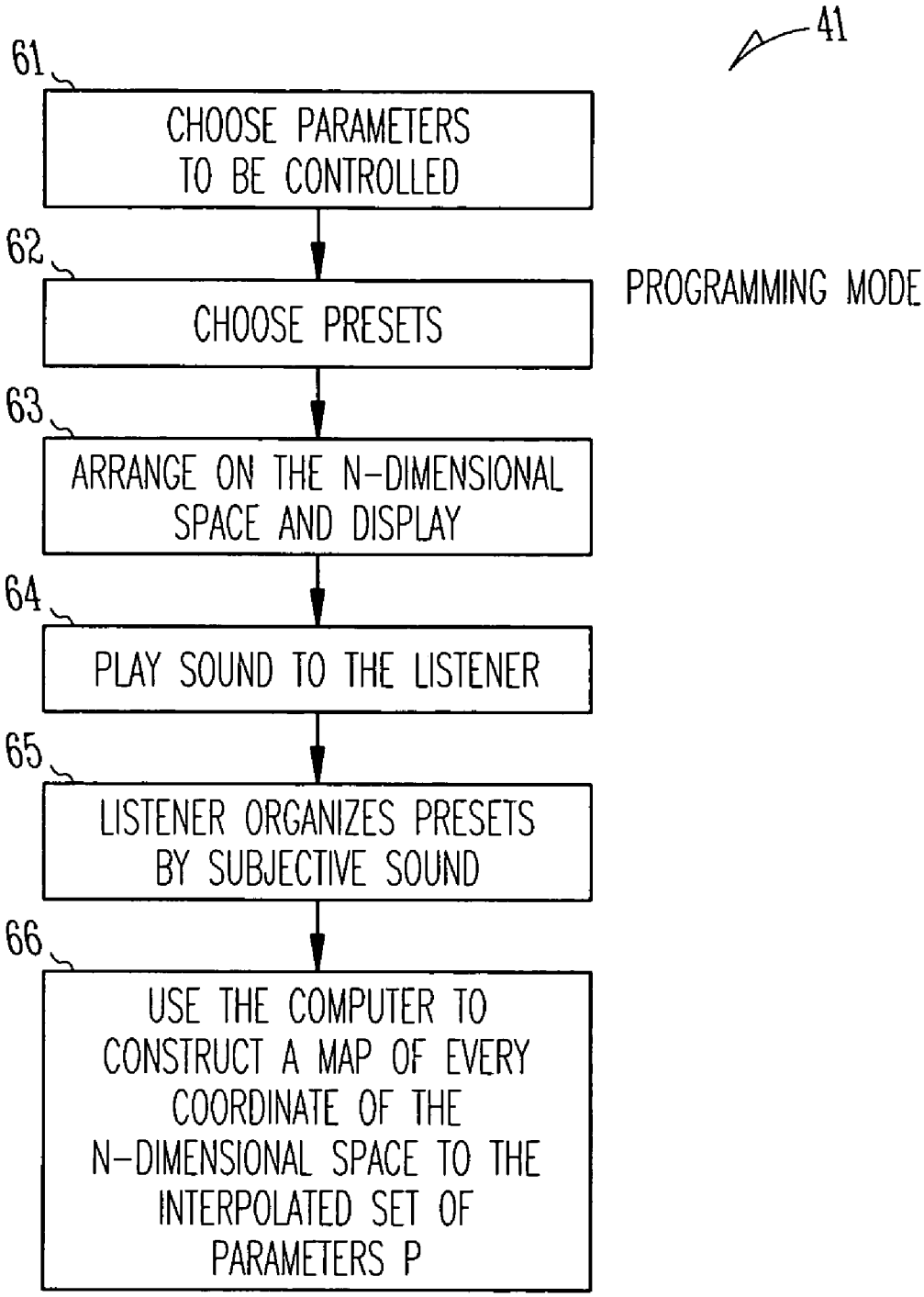
FIG. 5 demonstrates a process for the programming mode, according to one embodiment of the present subject matter.

FIG. 5 demonstrates a process for the programming mode, according to one embodiment of the present subject matter. In various embodiments, the system or user may select certain parameters of the digital signal processing algorithm to be controlled 61. For example, in hearing aid applications, the parameters may be one or more of thresholds, time constants, gains, attacks, decays, limits, to name a few. The parameters may be frequency dependent. Thus, the system may involve a substantial number of parameters to be controlled.

Once the parameters to be controlled are selected, the system can optionally provide a choice of a special nonlinear function to be applied to one or more parameters. For example, the nonlinear function can be a logarithmic function. One demonstrative example is that sometimes signal volume is better processed as the log of the signal volume. Other types of nonlinear functions may be optionally applied without departing from the scope of the present subject matter.

Once the parameters are selected a number of presets can be selected 62. The presets can be chosen to span a parameterization range of interest. The preset parameter values could be selected by an audiologist, an engineer, or could be done automatically using software. Such presets could be based on a listener's particular audiogram. For example, a person with high frequency hearing loss could have presets with a variety of audio levels in high frequency bands to assist in a diverse parameterization for that particular listener. In various embodiments, the presets could be selected based on population data. For example, predetermined presets could be used for listeners with a particular type of audiogram feature. Such settings may be developed based on knowledge of the signal processing algorithm. Such settings may also be determined empirically.

In various embodiments, the presets are selected to provide a diverse listening experience for the particular listener. Interpolations of similar parameter settings generally yield narrow interpolated parameter ranges. Thus, the presets need not be ones determined to sound "good," but rather should be diverse.

The presets are then arranged on the display 63 for the listener. Such arrangements may be random, as demonstrated by FIG. 7A. The display depicts the "subjective space" which the listener will use to organize the presets. The subjective space can be a plane (N=2; X and Y coordinates) or higher order space, such as a three dimensional shape (N=3; e.g., any orthogonal coordinates, including, but not limited to, Cartesian coordinates, spherical coordinates, cylindrical coordinates).

Sound is played to the listener using the signal processor 64. The parameters fed to the signal processing algorithm are those of the preset selected. Sound played to the listener can be via headphones. In hearing aid applications, the sound played to the listener can be made directly by hearing aids in one or both ears of the listener. In various embodiments, the sound is generated by the computer and/or programmer. In various embodiments the sound is natural ambient sound picked up by one or more microphones of the one or more hearing aids. Regardless, the signal processor 52 receives parameters Z from the Controller 51 based on the selected preset and plays processed sounds according to the selected preset parameters. It is understood that in various embodiments, the computer 2 or 3 or handheld device 12 or 13 could be implementing the controller 51. In various embodiments, the handheld device 12, 13 includes the controller 51, the signal processor 52, and the input device 9. In various embodiments, a hearing aid 8 is implementing the signal processor 52. In various embodiments, the hearing aid 8 implements the signal processor 52 and the controller 51. Other embodiments are possible without departing from the scope of the present subject matter.

Figure 7B:
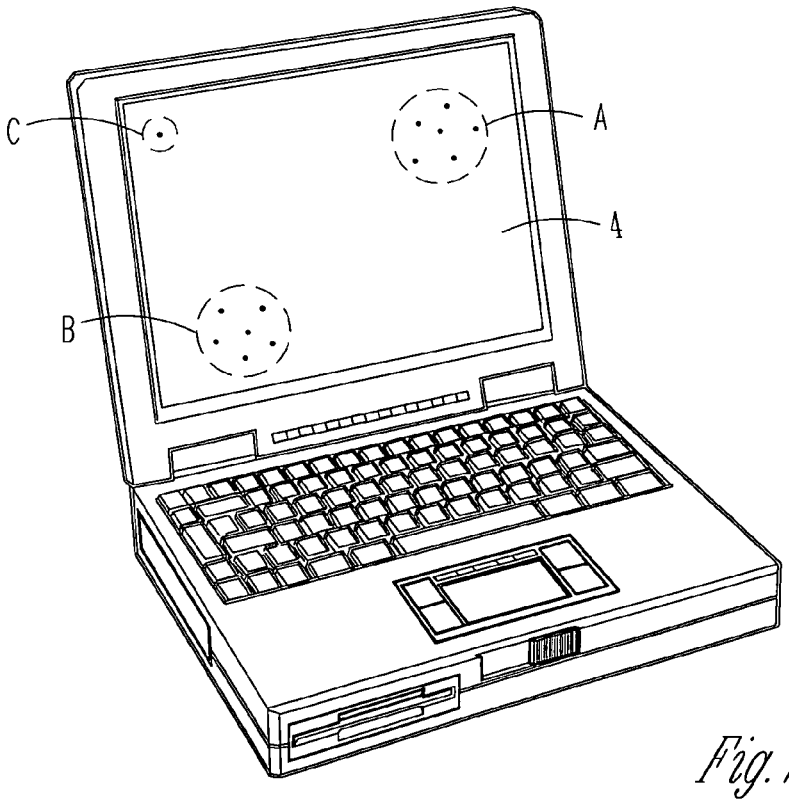
FIG. 7B shows an organization of presets by listener, according to one embodiment of the present subject matter.

The listener organizes the presets in the subjective space depending on sound 65. In one embodiment, the listener is listening to sound played using different presets and uses a graphical user interface on screen 4 to drag the preset icons to different places in the subjective space. In various embodiments, the listener is encouraged to organize things that sound similar closely in the subjective space and things that sound different relatively far apart in the subjective space. In various embodiments the listener is encouraged to use as much of the subjective space as possible. FIG. 7B demonstrates one such organization where the presets organized in the vicinity A are substantially different than the presets organized in the vicinity B by the listener. The preset in vicinity C is judged substantially different from all other presets, including those in vicinity A and vicinity B. Thus, the listener can generate his or her subjective organization of the sound played at each of the preset settings. The resulting interpolations will be based on this subjective organization of presets by the listener.

In various embodiments, the organization of presets in the subjective space is performed by an audiologist, an engineer, or other expert. In various embodiments, the organization of presets is performed according to population data, or according to the listener's audiogram or other attributes. In various embodiments, the listener participates in the programming and navigation modes of operation. In various embodiments, the listener participates only in the navigation mode of operation. Other variations of process are possible without departing from the scope of the present subject matter, and those provided herein are not intended to be exclusive or limiting.

Once the organization is complete, the computer constructs an interpolation scheme that maps every coordinate of the subjective space to an interpolated set of parameters according to the organization of the presets 66. In various embodiments, the organization is interpolated using distance-based weighting (e.g., Euclidean distance and weighted average). In various embodiments, the organization of presets is interpolated using a two-dimensional Gaussian kernel. In various embodiments, a radial basis function network is created to interpolate the organization of the presets. Other interpolation schemes are possible without departing from the scope of the present subject matter.

Figure 6:
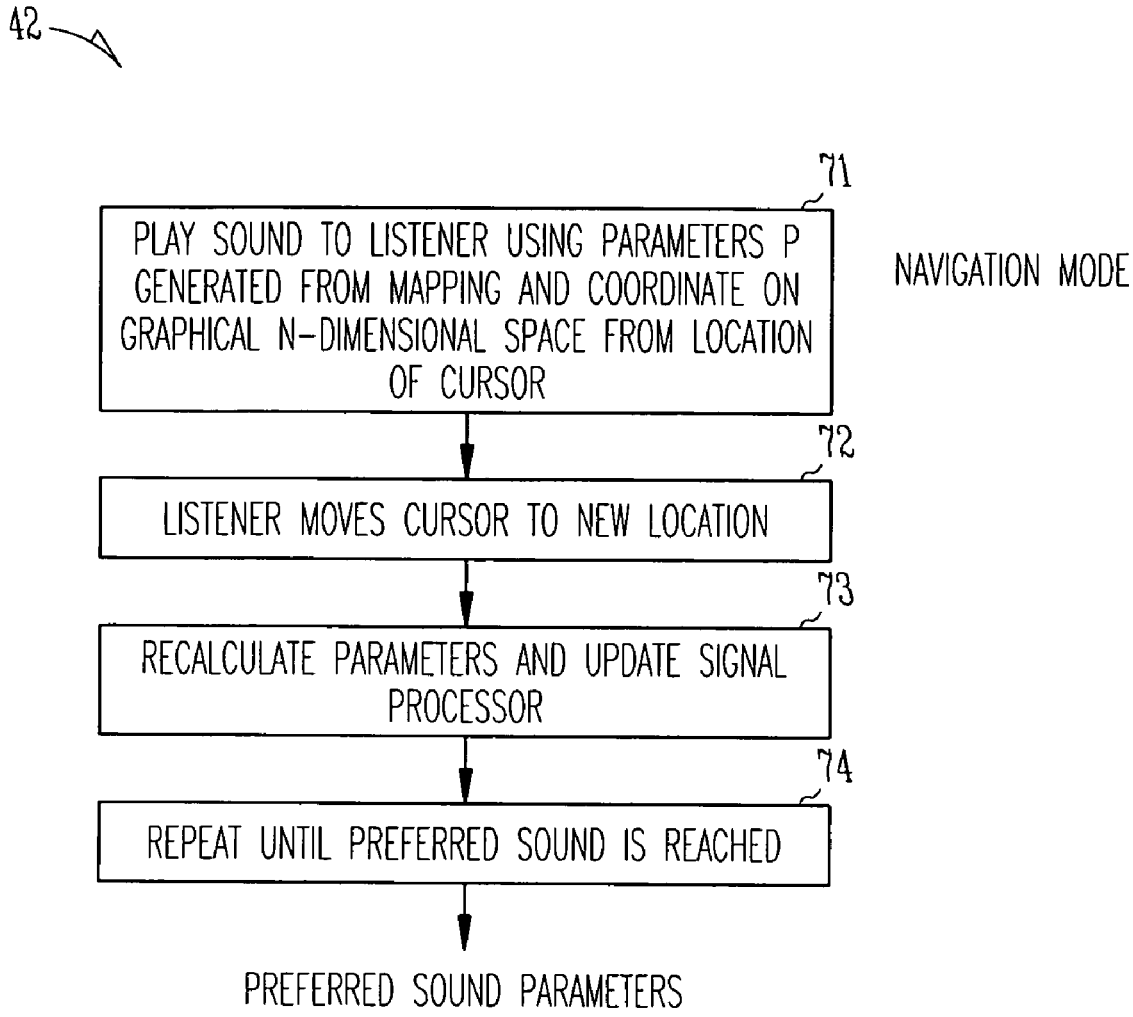
FIG. 6 shows a navigation mode according to one embodiment of the present subject matter.

FIG. 6 shows a navigation mode according to one embodiment of the present subject matter. Continuous generation of parameters Z from the coordinates of the entire subjective space can be performed for a continuous traversal of the subjective space. Sound is played to the listener as the listener navigates his or her cursor about the subjective space 71. The coordinates of the cursor provide inputs to the controller 51 for generation of the parameters Z according to the interpolation scheme which are subsequently used by the signal processor 52 to adjust the sound played to the listener. The listener can move the cursor on display 4 and thereby adjust the coordinates of the cursor in the subjective space 72, which results in the recalculation 73 of interpolated parameters Z used by the signal processor 52. This process can be repeated until the listener determines a "preferred" sound 74. The parameters used to generate that preferred sound can be stored. One or more sets of preferred settings can be made. Such settings can be stored for different sound environments.

In various embodiments, the presets can be hidden during the navigation phase so as to not distract the listener from navigating the subjective space.

Figure 8:
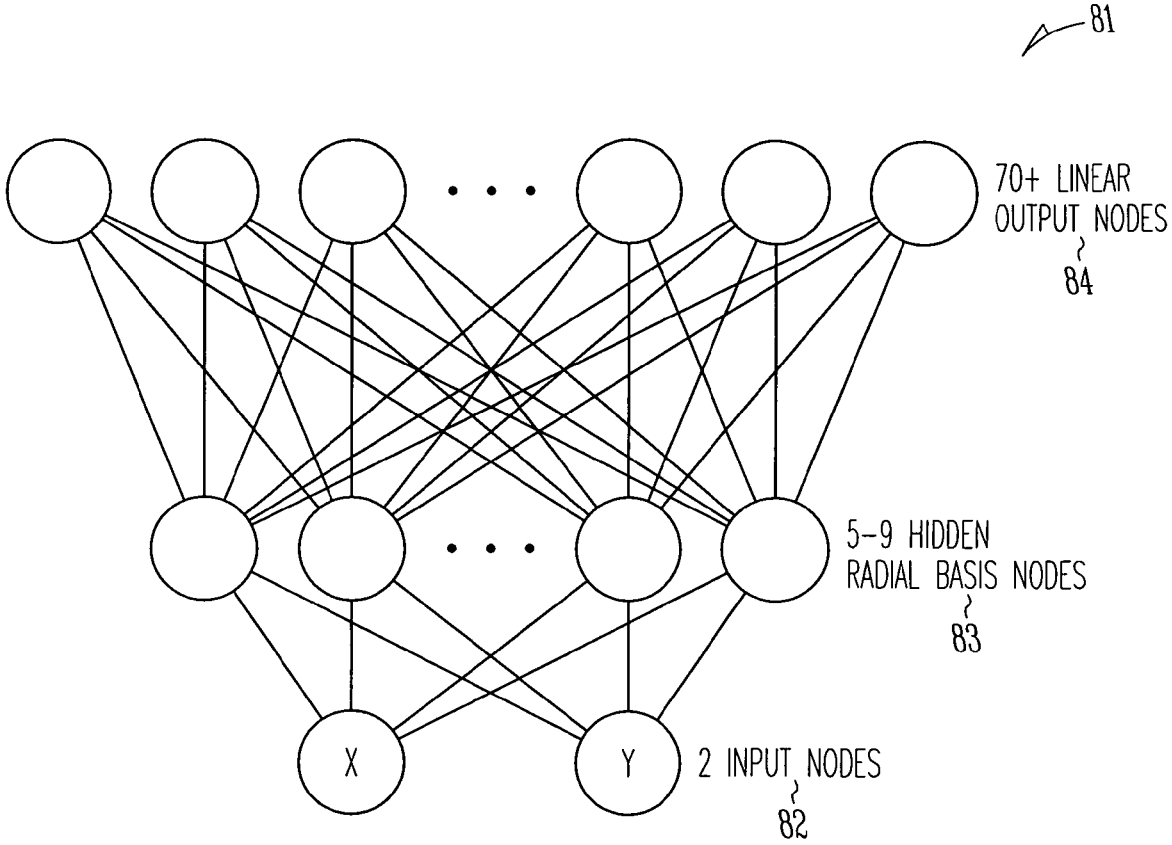
FIG. 8 demonstrates a radial basis function network including two input nodes, a plurality of hidden radial basis nodes, and a plurality of linear output nodes, according to one embodiment of the present subject matter.
Figure 9:
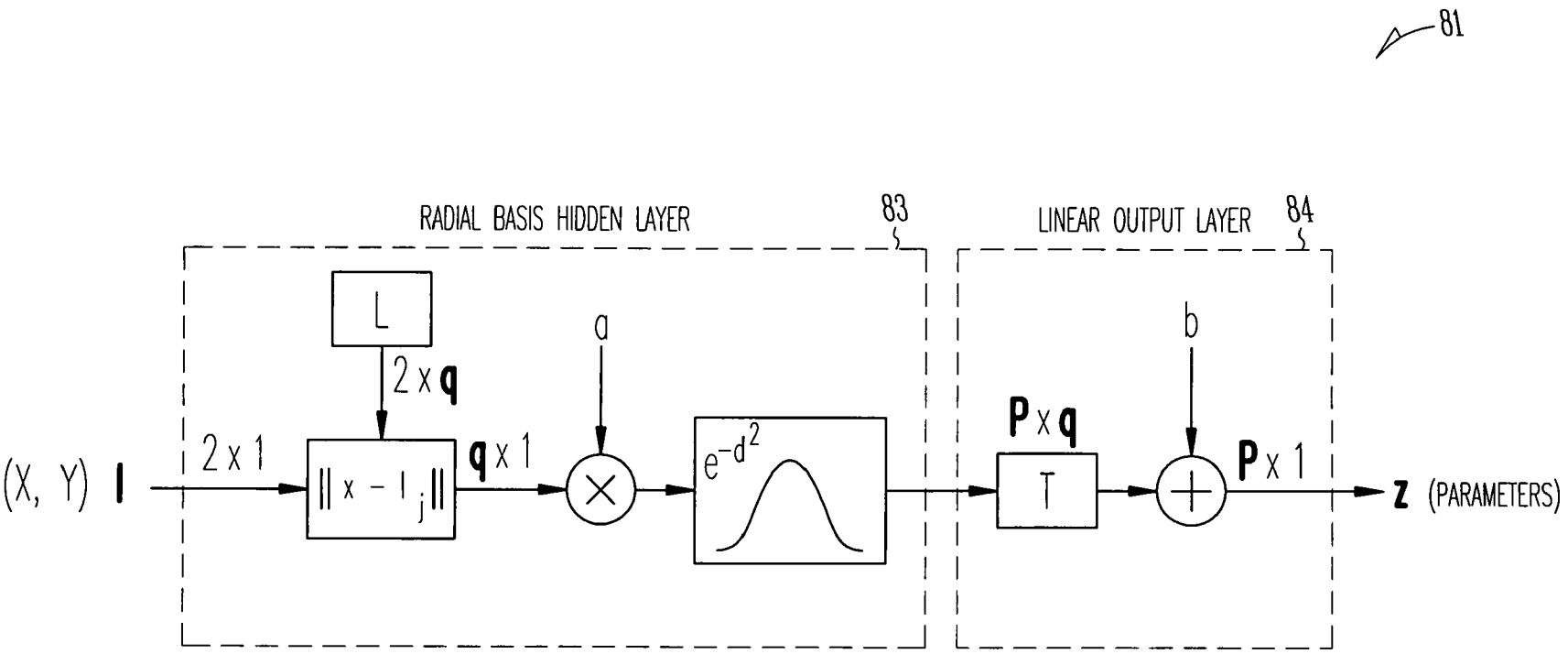
FIG. 9 shows a radial basis function network flow diagram, according to one embodiment of the present subject matter.

In some embodiments, a radial basis function network, such as the one demonstrated by FIG. 8, creates different parameters Z for the signal processor 52 as the cursor is moved around. FIG. 8 demonstrates a radial basis function network 81 including two input nodes (N=2) 82, a plurality of hidden radial basis nodes 83, equal in number to the number of presets, and a plurality of linear output nodes 84. The signal processing algorithm receives parameters from the linear output nodes 84 which perform a smooth and continuous interpolation of parameters as the user drags the cursor around the subjective space the listener created. FIG. 9 shows a signal diagram including calculations for a radial basis hidden layer and a linear output layer. The input is an N-dimensional input (N=2 in this example) and the output is a P-dimensional vector of interpolated parameters. The radial basis algorithm is described in further detail below.

In varying embodiments, the process is repeated for different sound environments. In various embodiments, artificial sound environments are generated to provide speech babble and other commonly encountered sounds for the listener. In various embodiments, measurements are performed in quiet for preferred quiet settings. In various embodiments a plurality of settings are stored in memory. Such settings may be employed by the listener at his or her discretion. In various embodiments, the subjective organization of the presets is analyzed for a population of subject listeners to provide a diagnostic tool for diagnosing hearing-related issues for listeners. It is understood that in various embodiments, the navigation mode may or may not be employed.

In applications involving hearing assistance devices, the interface provides a straightforward control of potentially a very large number of signal processing parameters. In cases where the hearing assistance devices are hearing aids, the system provides information that can be used in "fitting" the hearing aid to its wearer. Such applications may use a variety of presets based on information obtained from an audiogram or other diagnostic tool. The presets may be selected to have different parameterizations based on the wearer's particular hearing loss. Thus, the parameter range of interest for the presets may be obtained from an individual's specific hearing or from a group demographic. Such applications may also involve the use of different acoustic environments to perform fitting based on environment. Hearing assistance devices can include memory for storing preferred parameter settings that may be programmed and/or selected for different environments. Yet another application is the use of the present system by a wearer of one or more hearing aids who wants to find an "optimal" or preferred setting for her/his hearing aid for listening to music. Other benefits and uses not expressly mentioned herein are possible from the present teachings.

Interpolation Using a Radial Basis Function Network

In various embodiments, interpolation of the parameter presets may be performed using a radial basis function network 81 composed of a radial basis hidden layer 83 and a linear output layer 84 as shown in FIG. 8. This simple two layer neural network design performs smooth, continuous parameter interpolation.

The specifics of the system are shown in FIG. 9. To begin, the neural network takes the two dimensional input vector I and measures its distance from each of the q preset locations which are stored as the columns of a matrix L. The output of this distance measure is a q-dimensional vector which is then scaled by a constant a and then passed through the Gaussian radial basis function. The constant a affects the spread of the Gaussian function and ultimately controls the smoothness of the interpolation space. The output of the radial basis function is a q-dimensional vector of preset weights. For example, if the input location corresponds to one of the preset locations, then the weight corresponding to that preset would be 1. The radial basis weight vector is now the input to the linear output layer.

The linear layer consists of a mapping from the q-dimensional weight vector to the P-dimensional parameter space. This linear transformation is carried out using a matrix T, that left multiplies the weight vector w, and a constant vector b which is summed with the resulting matrix product Tw. If Z is the P-dimensional output vector of interpolated parameters, we have $$Z=Tw+b. \quad \text{(Eq. 1)}$$

The training of the network is simple and does not require complex iterative algorithms. This allows the network to be retrained in real-time, so that the user can instantly experience the effects of moving presets within the space. The network is trained so that each preset location elicits an output equal to the exact parameter set corresponding to that preset.

The values that must be determined by training are the preset location matrix L, the linear transformation matrix T, and the vector b. The matrix L is trivially constructed by placing each two-dimensional preset location in a separate column of the matrix. The matrix T and vector b are chosen so that if the input location lies directly on a preset, then the output will be the parameters corresponding to that preset. To solve for these, we can set up a linear system of equations. We can place T and b together in a matrix $$T'=[T|b]. \quad \text{(Eq. 2)}$$

Then we place the weight vectors corresponding to each preset location into a matrix W and append a row vector of ones, $1_{1xq}$, so that $$W' = \left[\frac{W}{1_{1xq}}\right]. \quad \text{(Eq. 3)}$$

Let the matrix V be the target matrix composed of columns of the parameters corresponding to each preset. Now our linear system of equations can be represented by the single matrix equation $$T'W'=V \quad \text{(Eq.4)}$$

Because there are more degrees of freedom in the system than constraints, the system is underdetermined and has infinitely many solutions. We choose the solution, T' with the lowest norm by right multiplying by the pseudo-inverse of W'. The solution with lowest norm was chosen to prevent the system from displaying erratic behavior and to keep any one weight from dominating the output. After we have solved for T and b, the training is complete. Compared to other neural network training procedures, such as back propagation, this method is extremely fast and still produces the desired results.

We have implemented a prototype listener-driven interactive system for adjusting the high dimensional parameter space of hearing aid signal processing algorithms. The system has two components. The first allows listeners to organize a two dimensional space of parameter settings so that the relative distances in the layout correspond to the subjective dissimilarities among the settings. The second performs a nonlinear regression between the coordinates in the subjective space and the underling parameter settings thus reducing the dimensionality of the parameter adjustment problem. This regression may be performed by a radial basis function neural network that trains rapidly with a few matrix operations. The neural network provides for smooth real-time interpolation among the parameter settings. Those knowledgeable in the art will understand that there are many other ways of interpolating between the presets other than using radial basis functions or neural networks.

The two system components may be used individually, or in combination. The system is intuitive for the user. It provides real-time interactivity and affords non-tedious exploration of high dimensional parameter spaces such as those associated with multiband compressors and other hearing aid signal processing algorithms. The system captures rich data structures from its users that can be used for understanding individual differences in hearing impairment as well as the appropriateness of parameter settings to differing musical styles.

It is understood that in various embodiments, the apparatus and processes set forth herein may be embodied in digital hardware, analog hardware, and/or combinations thereof.

The present subject matter includes hearing assistance devices, including, but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in-the-canal. It is understood that other hearing assistance devices not expressly stated herein may fall within the scope of the present subject matter.

This application is intended to cover adaptations and variations of the present subject matter. It is to be understood that the above description is intended to be illustrative, and not restrictive. The scope of the present subject matter should be determined with reference to the appended claim, along with the full scope of legal equivalents to which the claims are entitled.

What is claimed is:

1. A method for configuring signal processing parameters of a hearing assistance device of a listener, comprising:

selecting a plurality of signal processing parameters to control;

selecting a plurality of presets, including a setting for each of the plurality of parameters, at least one parameter chosen to span at least one parameter space of interest;

displaying the plurality of presets on an N-dimensional space;

recording the listener's organization of the plurality of presets in the N-dimensional space based on sound heard by the listener from the hearing assistance device processed according to the signal processing parameters at each preset;

constructing a mapping of coordinates of the N-dimensional space to the plurality of parameters using interpolation of the presets as organized by the listener in the N-dimensional space;

generating interpolated signal processing parameters from coordinates associated with a cursor position in the N-dimensional space according to the mapping; and providing the interpolated signal processing parameters to the hearing assistance device.

2. The method of claim 1, further comprising:

updating the interpolated signal processing parameters as the listener moves the cursor in the N-dimensional space, the updated signal processing parameters changing how the hearing assistance device processes audio such that the listener can hear changes from processing using the updated signal processing parameters.

3. The method of claim 2, comprising:

storing a preferred set of interpolated parameters based on user preference.

4. The method of claim 1, wherein the generating is performed upon a nonlinear function of at least one parameter.

5. The method of claim 4, wherein the nonlinear function is the logarithm of the at least one parameter.

6. The method of claim 4, wherein the nonlinear function is the inverse of the parameter.

7. The method of claim 1, wherein N=2.

8. The method of claim 1, wherein N=3.

9. The method of claim 1, wherein the generating includes using a radial basis function network to generate the interpolated parameters.

10. The method of claim 1, wherein selecting the plurality of presets comprises selecting the plurality of presets based on population data.

11. The method of claim 1, wherein the interpolation comprises interpolating using distance-based weighting.

12. The method of claim 11, wherein the interpolation comprises interpolating using Euclidian distance and weighting average.

13. The method of claim 1, wherein the interpolation comprises interpolating using a two-dimensional Gaussian kernel.

14. A method of operating a hearing assistance device of a listener, comprising:

moving a pointer in a graphical representation of an N-dimensional space while the listener is listening to sound processed by a signal processing algorithm executing on the hearing assistance device;

updating a plurality of signal processing parameters as the pointer is moved, the updated signal processing parameters generated from a mapping of coordinates of the N-dimensional space to the plurality of parameters; and providing the updated signal processing parameters to the signal processing algorithm.

15. The method of claim 14, wherein the mapping of coordinates of the N-dimensional space to the plurality of parameters is accomplished using interpolation of presets that are organized from user population data.

16. The method of claim 14, wherein moving the pointer comprises moving a computer mouse.

17. The method of claim 14, comprising:

receiving the listener's organization of a plurality of presets in the N-dimensional space based on sound heard by the listener from the hearing assistance device processed according to the signal processing parameters at each preset of the plurality of presets; and constructing the mapping of coordinates of the N-dimensional space to the plurality of parameters using interpolation of the plurality of presets according to the listener's organization of the plurality of presets in the N-dimensional space.

18. The method of claim 17, wherein the interpolation comprises interpolating using distance-based weighting.

19. The method of claim 17, wherein the interpolation comprises interpolating using Euclidian distance and weighting average.

20. The method of claim 17, wherein the interpolation comprises interpolating using a two-dimensional Gaussian kernel.

* * * * *